US006598300B2

(12) United States Patent
Huang

(10) Patent No.: US 6,598,300 B2
(45) Date of Patent: Jul. 29, 2003

(54) STRUCTURE FOR A LOCATING PIVOT OF SHEARS

(75) Inventor: Chin-Chi Huang, Chung Hwa Hsien (TW)

(73) Assignee: Hung Chuan Hsian Industries Co., Ltd., Chung Hwa Hsien (TW)

( * ) Notice: Subject to any disclaimer, the term of this patent is extended or adjusted under 35 U.S.C. 154(b) by 0 days.

(21) Appl. No.: 09/976,711

(22) Filed: Oct. 15, 2001

(65) Prior Publication Data

US 2003/0070300 A1 Apr. 17, 2003

(51) Int. Cl.[7] ..... B26B 13/16
(52) U.S. Cl. ..... 30/262; 30/254; 30/261
(58) Field of Search ..... 30/260, 261, 262, 30/266, 270, 341, 254

(56) References Cited

U.S. PATENT DOCUMENTS 4,031,621 A * 6/1977 Arlett ..... 30/262
4,980,975 A * 1/1991 Hodson ..... 30/262
5,483,747 A * 1/1996 Thompson et al. ..... 30/254
6,367,155 B2 * 4/2002 Homann ..... 30/260
6,418,626 B1 * 7/2002 Jang ..... 30/262

* cited by examiner

*Primary Examiner*—Hwei-Siu Payer
(74) *Attorney, Agent, or Firm*—Harrison & Egbert

(57) ABSTRACT

A pivoting structure is provided to pivot together a first working block, a cutting blade, and a second working block of a pair of shears in such a manner that the cutting blade and the second working block work against each other to effect the scissors action. The pivoting structure includes a first locating slot disposed in the first working block, a pivot located in the first locating slot, a second locating slot disposed in the second working block, and a nut engaged with the pivot and located in the second locating slot.

1 Claim, 5 Drawing Sheets

STRUCTURE FOR A LOCATING PIVOT OF SHEARS

BACKGROUND OF THE INVENTION

1. Field of the Invention

The present invention relates generally to a pair of shears, and more particularly to a structure for pivoting two opposing blades of the shears.

2. Description of Related Art

As shown in FIGS. 1 and 2, a cutting device 10 of the prior art comprises two main bodies 11 and 12, each having a blade 13. The two opposing blades 13 are pivoted together by a pivoting structure 18 which is formed of a pivot 16 and a nut 17, thereby enabling the two opposing blades 13 to work against each other. The pivoting structure 18 of the prior art device 10 is susceptible to impact by a foreign object, thereby resulting in the loosening of the pivoting structure 18. As a result, the scissors action of two cutting edges of the two opposing blades 13 is seriously undermined.

BRIEF SUMMARY OF THE INVENTION

The primary objective of the present invention is to provide a pair of shears with means to locate securely a pivoting structure of the shears, so as to overcome the deficiency of the prior art shears described above.

In keeping with the principle of the present invention, the foregoing objective of the present invention is attained by a cutting instrument comprising two handles, two working block, and a structure for pivoting the two working blocks together so that they work against each other to effect the scissors action. The pivoting structure comprises a pivot, a nut, and two locating slots which are disposed respectively in the two working blocks for locating the pivot and the nut so as to prevent the pivot and the nut from becoming loosened.

The features and the functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
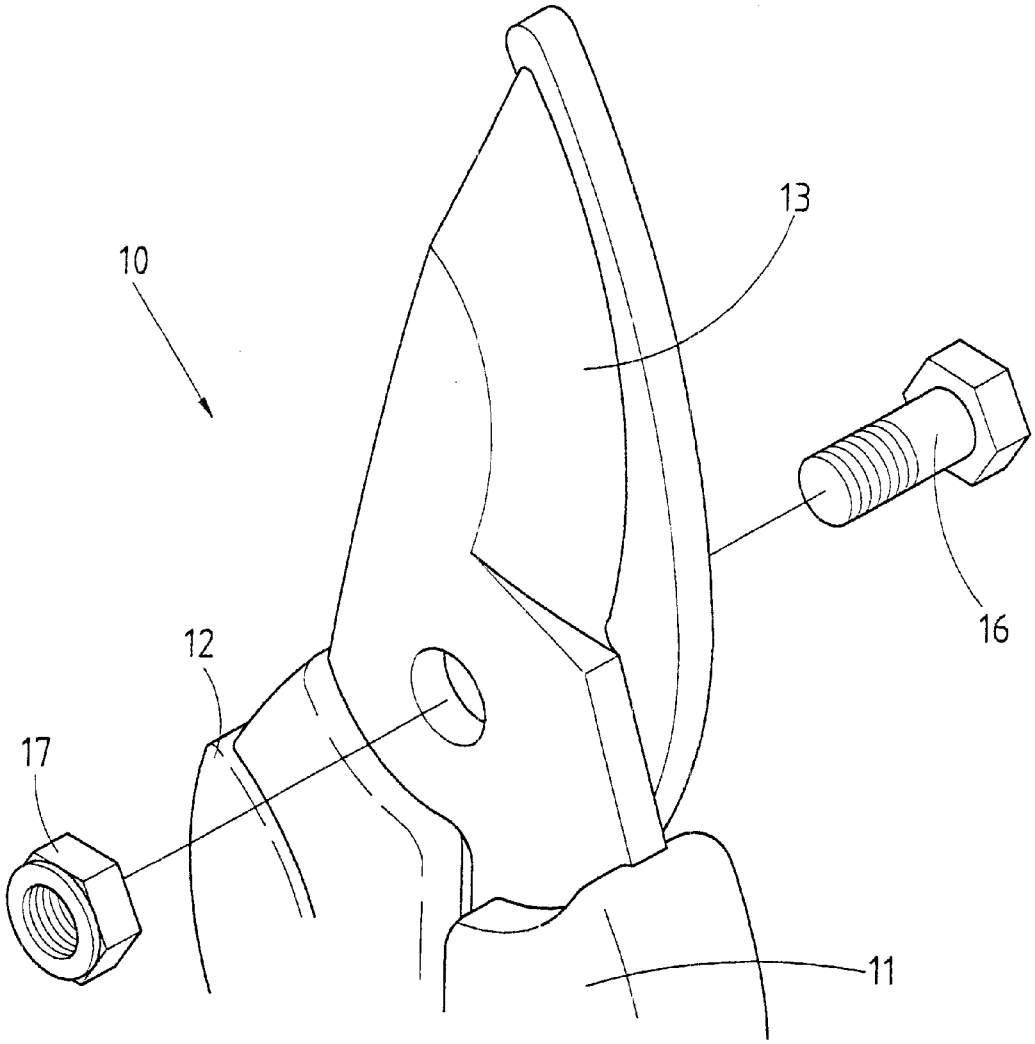
FIG.1 PRIOR ART
FIG. 1 shows an exploded schematic view of a pivoting structure of a prior art pair of shears.
Figure 2:
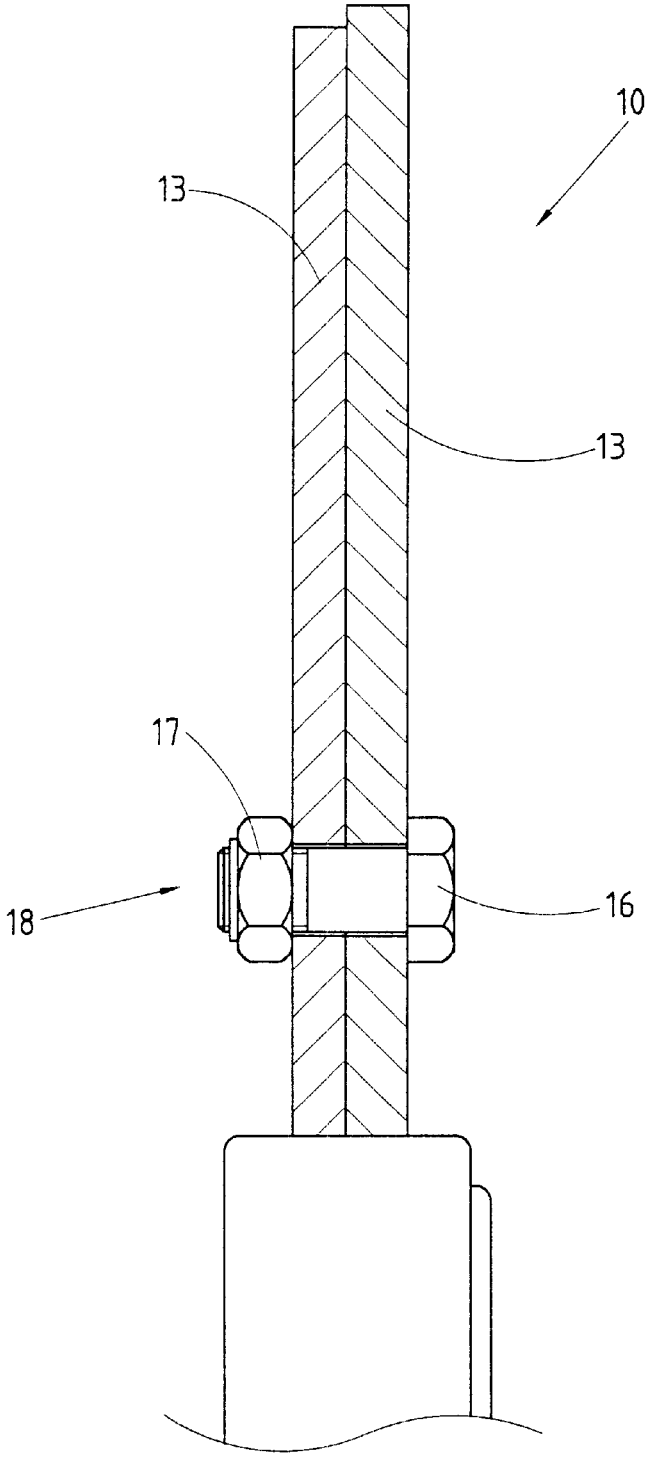
FIG.2 PRIOR ART
FIG. 2 shows a sectional view of the pivoting structure of prior art shears.
Figure 3:
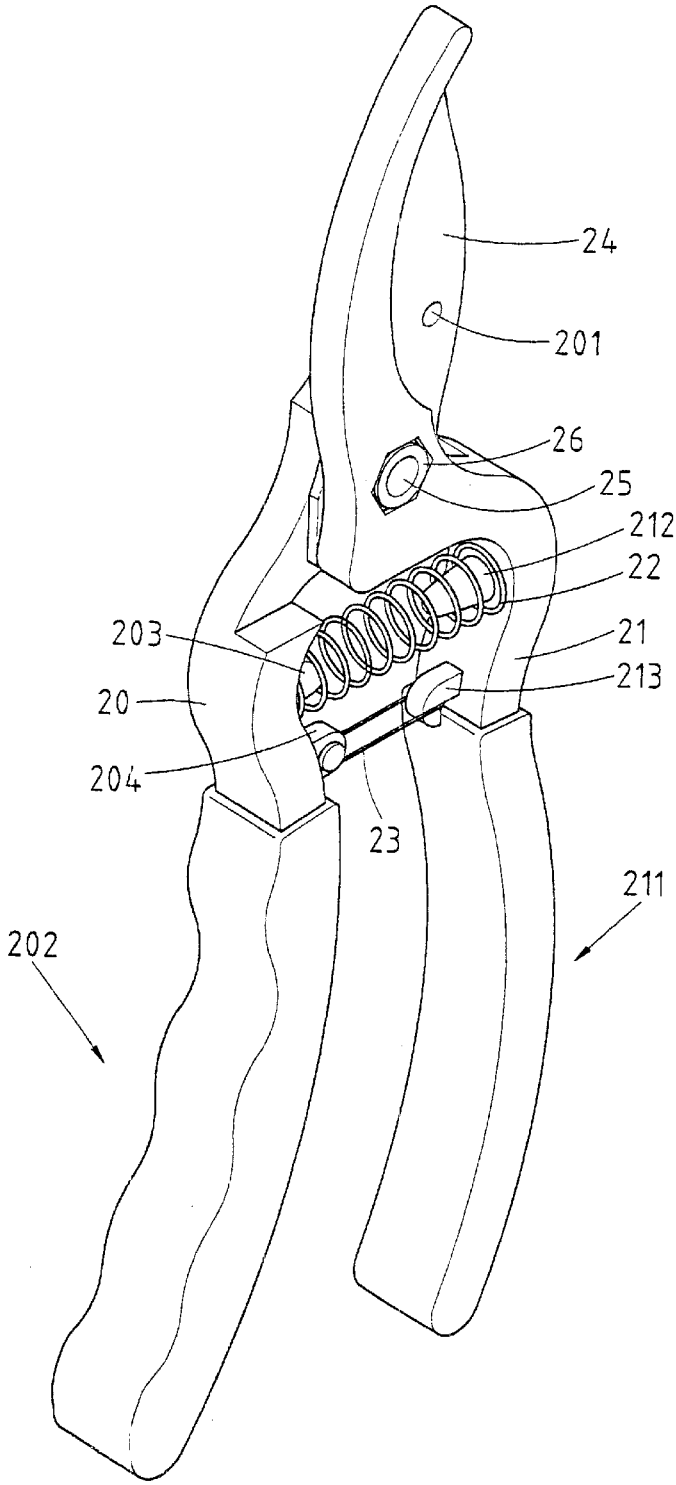
FIG. 3 shows a perspective view of a pair of shears of the preferred embodiment of the present invention.
Figure 4:
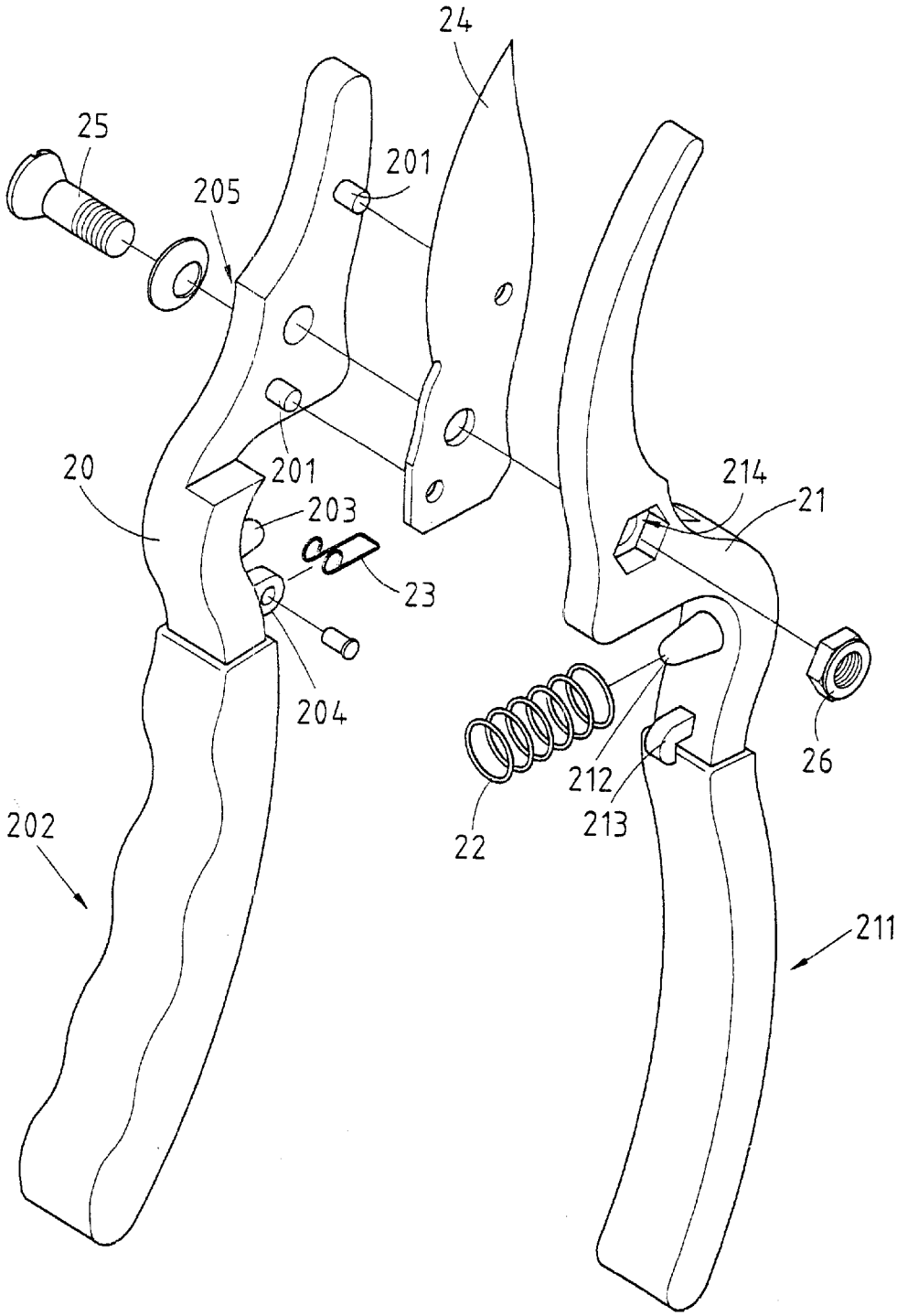
FIG. 4 shows an exploded schematic view of the shears of the preferred embodiment of the present invention.
Figure 5:
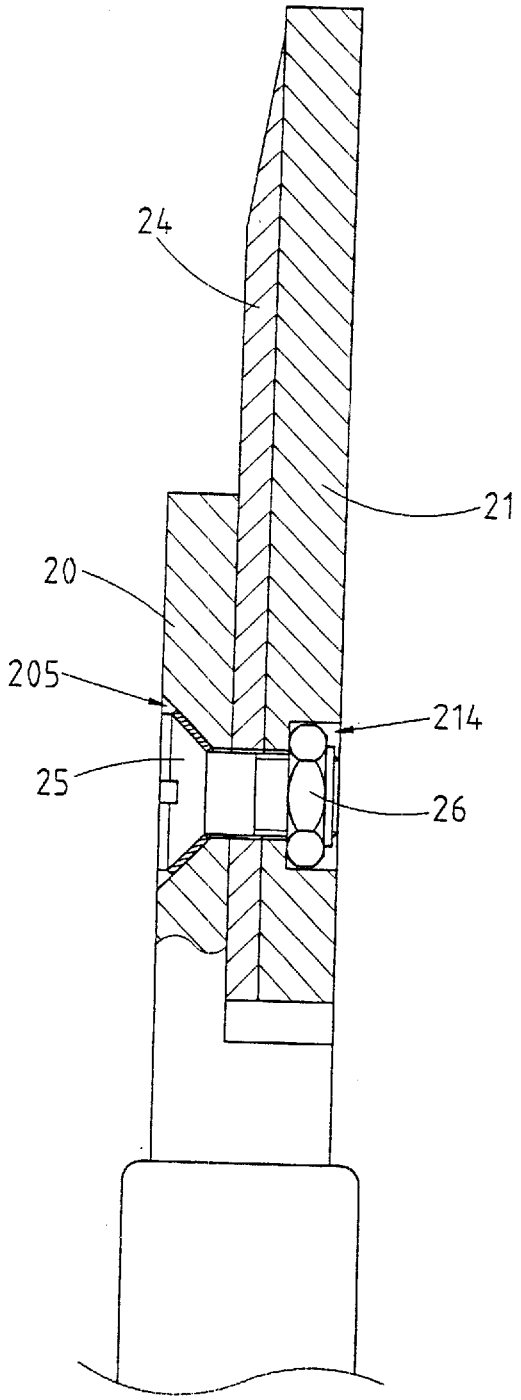
FIG. 5 shows a sectional view of the pivoting structure of the shears of the preferred embodiment of the present invention.

As shown in FIGS. 3–5, the preferred embodiment of the present invention comprises a first handle 202, a first working block 20 extending from one end of the first handle 202, a cutting blade 24 retained by the first working block 20, a second handle 211, a second working block 21 extending from one end of the second handle 211, and a pivoting structure for pivoting the first working block 20, the cutting blade 24, and the second working block 21 together such that the cutting blade 24 and the second working block 21 work against each other so as to bring about the scissors effect.

The first working block 20 is provided with two retaining projections 201 for retaining the cutting blade 24, a first locating pillar 203, a first retaining protrusion 204, and a retaining piece 23 whose one end is held by the retaining protrusion 204.

The second working block 21 is provided with a second locating pillar 212 corresponding in location to the first locating pillar 203 of the first working block 20, a second retaining protrusion 213 corresponding in location to the first retaining protrusion 204 of the first working block 20, and a spring 22 fitted at one end over the second locating pillar 212. The second working block 21 and the first working block 20 are joined together such that the other end of the retaining piece 23 is held by the second retaining protrusion 213 of the second working block 21, and that the other end of the spring 22 is fitted over the first locating pillar 203 of the first working block 20.

The first working block 20, the cutting blade 24, and the second working block 21 are pivoted together by a pivoting structure comprising a pivot 25, a first locating slot 205 in which the pivot 25 is located, a nut 26 which is engaged with the pivot 25, and a second locating slot 214 in which the nut 26 is located. The first locating slot 205 is disposed in the outer side wall of the first working block 20, whereas the second locating slot 214 is disposed in the outer side wall of the second working block 21, as shown in FIGS. 4 and 5.

In view of the fact that the head of the pivot 25 is inserted into the first locating slot 205 of the first working block 20, and that the nut 26 is fitted into the second locating slot 214 of the second working block 21, the pivot 25 and the nut 26 of the pivoting structure of the present invention are not vulnerable to impact or mechanical friction by a foreign object. In other words, the pivot 25 and the nut 26 of the present invention can not be easily loosened by the external force of the foreign object.

The embodiment of the present invention described above is to be regarded in all respects as being merely illustrative and nonrestrictive. Accordingly, the present invention may be embodied in other specific forms without deviating from the spirit thereof. The present invention is therefore to be limited only by the scope of the following claim.

I claim:

1. A pair of shears comprising:

a first handle;

a first working block extending from one end of said first handle, said first working block having a first locating slot formed therein, said first locating slot having an opening on one side of said first working block;

a cutting blade affixed to an opposite side of said first working block, said cutting blade having a hole formed therein, said hole being axially aligned with said first locating slot;

a second handle;

a second working block extending from one end of said second handle, said second working block having a second locating slot formed therein, said second locating slot having an hexagonal-shaped hole formed so as to open on one side of said second working block; and a pivoting means for pivoting said first and second handles such that said cutting blade and said second working block work against each other in a scissors action, said pivoting means comprising:

a bolt having a head at one end thereof and a shank extending from said head, said head received within said first locating slot such that a surface of said head opposite said shank is flush with or inward of said one side of said first working block, said shank extending through said first locating slot and through said hole of said cutting blade and into said second locating slot, said shank having an end opposite said head, said end of said shank residing flush with or inward of said one side of said second working block; and a nut threadedly affixed to said shank of said bolt, said nut positioned in said hexagonal-shaped hole inwardly of said one side of said second working block.

* * * * *

UNITED STATES PATENT AND TRADEMARK OFFICE

CERTIFICATE OF CORRECTION

PATENT NO. : 6,598,300 B2
APPLICATION NO. : 09/976711
DATED : October 25, 2005
INVENTOR(S) : Vaartstra et al.

It is certified that error appears in the above-identified patent and that said Letters Patent is hereby corrected as shown below:

Column 20, line 9, Claim 30, please delete "The of claim 29 wherein method" and insert -- The method of claim 29 wherein--.

Signed and Sealed this

Fourth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 6,598,300 B2
APPLICATION NO. : 09/976711
DATED : July 29, 2003
INVENTOR(S) : Chin-Chi Huang It is certified that error appears in the above-identified patent and that said Letters Patent is hereby corrected as shown below:

This certificate supersedes Certificate of Correction issued September 4, 2007. The certificate should be vacated since no Certificate of Correction was granted for this patent number.

Signed and Sealed this

Twenty-seventh Day of November, 2007

JON W. DUDAS
*Director of the United States Patent and Trademark Office*